US007537214B2

(12) United States Patent
Gotoh et al.

(10) Patent No.: US 7,537,214 B2
(45) Date of Patent: May 26, 2009

(54) METHOD FOR DETECTING HEIGHT OF PAPER BUNDLE AND PAPER HANDLING DEVICE

(75) Inventors: Yasushi Gotoh, Inagi (JP); Mitsutaka Nishida, Inagi (JP); Hiroshi Miyazaki, Inagi (JP)

(73) Assignee: Fujitsu Limited, Kawasaki (JP)

( * ) Notice: Subject to any disclaimer, the term of this patent is extended or adjusted under 35 U.S.C. 154(b) by 167 days.

(21) Appl. No.: 11/520,688

(22) Filed: Sep. 14, 2006

(65) Prior Publication Data

US 2007/0007355 A1 Jan. 11, 2007

Related U.S. Application Data

(63) Continuation of application No. PCT/JP2004/017696, filed on Nov. 29, 2004.

(30) Foreign Application Priority Data

Mar. 15, 2004 (JP) ..... 2004-073611

(51) Int. Cl.
*B65H 7/02* (2006.01)

(52) U.S. Cl. ..... 271/265.04; 271/265.01; 271/153; 271/262

(58) Field of Classification Search ..... 271/265.01, 271/265.04, 153, 262
See application file for complete search history.

(56) References Cited

U.S. PATENT DOCUMENTS 4,332,375 A * 6/1982 Tsubo ..... 271/9.05
4,988,085 A * 1/1991 Maekawa et al. ..... 270/58.11
6,095,512 A * 8/2000 Vijuk et al. ..... 271/3.05
6,182,962 B1 * 2/2001 Leuthold ..... 271/152
6,308,948 B1 * 10/2001 Azumi ..... 271/207
6,412,769 B1 * 7/2002 Goda et al. ..... 271/94
6,412,994 B1 * 7/2002 Collard ..... 400/624
6,585,344 B2 * 7/2003 Kolodziej ..... 347/19
6,615,105 B2 * 9/2003 Masotta ..... 700/219

(Continued)

FOREIGN PATENT DOCUMENTS

JP 57-137046 8/1982

(Continued)

OTHER PUBLICATIONS

Notice of Rejection Grounds (for the corresponding Japanese patent application) dated Jan. 29, 2008 w/English translation.

(Continued)

*Primary Examiner*—Patrick H Mackey
*Assistant Examiner*—Prasad V Gokhale
(74) *Attorney, Agent, or Firm*—Kratz, Quintos & Hanson, LLP

(57) ABSTRACT

A stage on to which a bill bundle is carried is moved to a lower end position in order to feed the bills through a feeding mechanism. The bill bundle is pressed by a pusher so that a bill located at the bottom touches a pick roller with appropriate pressure. With reference to a position being detected by a sensor, the distance over which the stage is moved below that position is determined. The distance is subtracted from the maximum distance over which the stage is movable downward from the reference position, thus determining the height of the bundle of papers when it is pressed.

2 Claims, 7 Drawing Sheets

U.S. PATENT DOCUMENTS

| | | | | |
|---|---|---|---|---|
| 6,986,509 | B2 * | 1/2006 | Koh et al. | 271/110 |
| 7,048,273 | B2 * | 5/2006 | Meckes et al. | 271/258.01 |
| 7,177,554 | B2 * | 2/2007 | Van Vliembergen | 399/23 |
| 2001/0054791 | A1 * | 12/2001 | Goldbeck et al. | 271/220 |
| 2002/0079361 | A1 | 6/2002 | Kosugi | |
| 2007/0007707 | A1 * | 1/2007 | Abe et al. | 271/97 |

FOREIGN PATENT DOCUMENTS

| | | |
|---|---|---|
| JP | 62-153039 | 7/1987 |
| JP | 1-112475 | 5/1989 |
| JP | 1-217692 | 8/1989 |
| JP | 01-217692 | 8/1989 |
| JP | 02-112091 | 4/1990 |
| JP | 9-208086 | 8/1997 |
| JP | 2000-191216 | 7/2000 |
| JP | 2002-190051 | 7/2002 |

OTHER PUBLICATIONS

Office Action of Korean patent application dated Sep. 21, 2007 with English translation.

* cited by examiner

METHOD FOR DETECTING HEIGHT OF PAPER BUNDLE AND PAPER HANDLING DEVICE

CROSS REFERENCE

This application is a continuation of international PCT application No. PCT/JP2004/017696 filed on Nov. 29, 2004.

BACKGROUND OF THE INVENTION

1. Field of the Invention

The present invention relates to a paper handling device in which a paper bundle piling one or more paper can be externally inserted.

2. Description of the Related Art

Recently, automation equipment, such as a cash dispenser (CD), an automated teller machine (ATM) and the like, are installed not only in financial institutes but also convenience stores and the like. A paper handling device is mounted on such automation equipment in order to handle bills as papers. In such a case, the paper handling device operates according to the instruction of the automation equipment.

The larger the number of pieces of bills is, the more troublesome it becomes for a customer to input bills one by one. Therefore, a bill bundle can be inputted to the automation equipment. Since sometimes only one piece of bill is inputted, the bill bundle means one piece of bill or more than two pieces of bills.

It cannot be expected for a customer to appropriately insert a bill bundle. For example, sometimes a customer inserts a bill bundle beyond allowance peculiar to automation equipment or a paper handling device. Therefore, some paper handling devices detect the height of an inserted bill bundle and return bill bundle whose height exceeds its height limit.

The height is conventionally detected by piling up a bill bundle horizontally or in a slope. However, since a piece of bill is light and has large elasticity compared with its weight, the total height of piled bills varies depending on their elasticity. Therefore, the height of a bill bundle cannot be always accurately detected. As a result, even when a bill bundle which number is below the limit of number to be handled is inserted, some bill bundles are often retuned to a customer.

Such a return requires a customer of labor more than needed. It also degrades the efficiency in use of automation equipment. For such a reason, it is important to measure the height of an externally inserted bill bundle more accurately.

Patent reference 1: Japanese Patent Application No. 2002-190051

Patent reference 2: Japanese Patent Application No. 2000-191216

SUMMARY OF THE INVENTION

It is an object of the present invention to provide a technology for accurately detecting the height of a bill bundle externally inserted in a paper handling device.

A method for detecting the height of a bundle of papers of the present invention is applied to a paper handling device for detecting the height of a paper bundle externally inserted which is piled at least one paper, and the height of the paper bundle is detected in its pressed state, by pressing an externally inserted paper bundle in the piled direction of the papers.

When a paper bundle to be collectively handled can be inserted in a paper handling device over a plurality of times, it is preferable to calculate the maximum number of pieces of papers anticipated to be able to subsequently insert, based on a predetermined upper limit of the height as well as the height of each paper bundle.

The paper handling device of the present invention presumes that an externally inserted paper bundle is handled, and comprises a feeding unit for feeding out papers one piece by one piece from the paper bundle which is piled at least one paper and was inserted from the externally, a height detection unit for detecting the height of the paper bundle pressed by the feeding unit and a carrying control unit for determining whether the height of the paper bundle detected by the height detection unit exceeds the predetermined height upper limit and externally discharging the paper bundle of the feeding unit when it is determined that the detected height exceeds the upper limit.

When the paper bundle to be collectively handled can be inserted in a paper handling device over a plurality of times, it is preferable for the feeding control unit to calculate the maximum number of pieces of papers anticipated to be able to subsequently insert as the paper bundle, based on the height detected for each paper bundle, detected by the height detection unit and its upper limit, and notify an external device of it. It is also preferable to calculate the thickness of one piece of the papers, based on the number of pieces of papers fed by the feeding unit and the height detected by the height detection unit, and to calculate the maximum number of pieces using the calculated thickness.

The present invention presses an externally inserted paper bundle which is piled at least one piece of paper in its piled direction and detects the height of the paper bundle in its pressed state. Therefore, the influence of the elasticity of each piece of paper can be excluded, and the actual height of the paper bundle can be accurately detected.

The paper handling device usually presses the paper bundle regardless of whether an inserted bundle of papers is carried without pressing it or is fed one piece by one piece. Therefore, when the method is applied to the paper handling device, an actually appropriate paper bundle can be avoided from being regarded as inappropriate.

For example, in automation equipment, such as an ATM or the like, bills can be additionally deposited. In this case, bills being papers are inserted over a plurality of times. Although bills are inserted over a plurality of times, it is desired to return bills at one time. For that purpose, usually an upper limit (upper limit in height of a bill bundle) is set to the number of pieces of bills to be inserted. Therefore, if the maximum number of pieces of papers to be anticipated to subsequently insert is also calculated based on the height of each paper bundle to detect and a predetermined limit of height when the paper bundle to handle is externally inserted over a plurality of times, papers can be surely avoided from being inserted beyond the limit.

DESCRIPTION OF THE PREFERRED EMBODIMENTS

The preferred embodiments of the present invention are described in details below with reference to the drawings.

Figure 1:
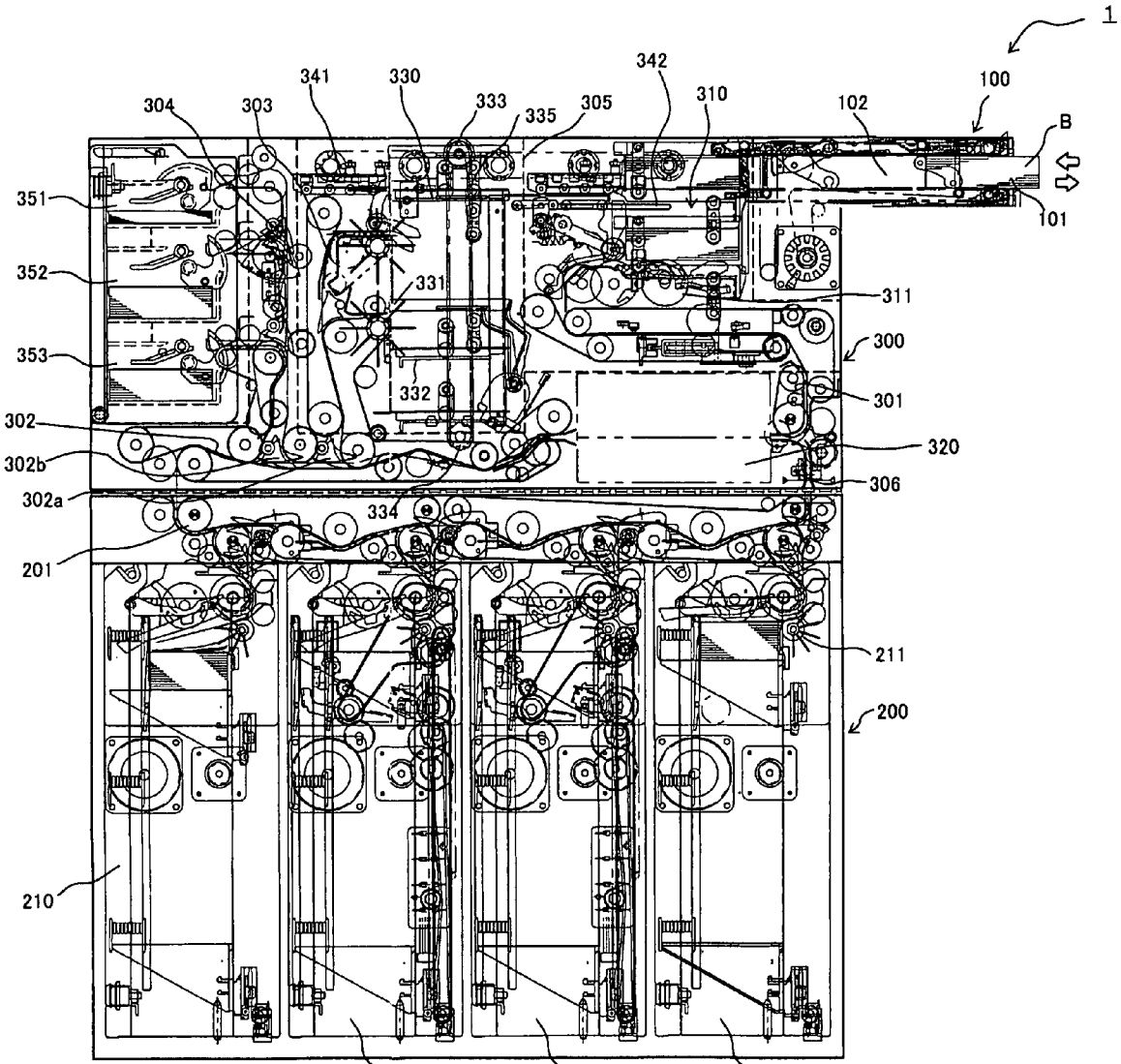
FIG. 1 is the section view of the paper handling device of the preferred embodiment.

FIG. 1 is the section view of the paper handling device of the preferred embodiment.

The paper handling device 1 is anticipated to be used for automation equipment, such as an automatic teller machine (ATM), and handles bills as papers. As shown in FIG. 1, the paper handling device comprises a pre-acceptor 100 for taking in a bundle of one or more piled bills B inside when a customer inserts it, a lower unit 200 for storing bills and an upper unit 300 for carrying bills between the lower unit and the pre-acceptor 100. The pre-acceptor 100 is called an "acceptor" or "PAC" hereinafter.

In the above-mentioned configuration, its operation is described. Since the paper handling device 1 can deposit and pay bills, the operation is divided into deposit and payment and each of them is described. It is assumed that an ATM is used for automation equipment to mount the paper handling device 1, in other words, it is assumed that the paper handling device 1 operates according to instructions from the ATM MAIN BODY.

An input/output slit 101 provided for the acceptor 100 is used for a customer to input a bill bundle B for deposit or to externally discharge the bill bundle B for payment. When the paper handling device 1 is mounted on an ATM, a shutter, which is not shown in FIG. 1, is provided outside the input/output slit 101. Hereinafter, from the viewpoint of a customer, the input/output slit 101 side of the acceptor 100 and the reverse side is called as front and back sides, respectively. When the paper handling device 1 is viewed from the lower unit 200 with the upper unit 300 side is called upper side and the reverse is called lower part, respectively.

Firstly, the operation at the time of deposit is described in detail. The deposit is made, for example, by a customer operating the operation panel, which is not shown in FIG. 1, of the ATM, and requesting for deposit. When the customer issuing the request, the ATM MAIN BODY opens the shutter to prepare for the customer to insert (input) a bill bundle B in the input/output slit 101 and instructs the paper handling device 1 to take in the inserted bill bundle B.

In the vicinity of the input/output slit 101, a sensor for detecting the inserted bill bundle B is provided. Upon receipt of the instruction from the ATM MAIN BODY, the paper handling device 1 carries the bill bundle B as soon as the sensor has detected it. Then, the bill bundle B is carried to the separator (SEP) unit 310 of the upper unit 300 over a paper path 102. The separator unit 310 corresponds to the feeding unit of the present invention.

After taking in the bill bundle B inserted by the customer, the paper handing device 1 notifies the ATM MAIN BODY of the fact. Then the ATM main body shuts the shutter.

In the lower part of the separator 310, a feeding mechanism 311 for feeding the bill bundle B one by one is provided. Each piece of bill constituting the bundle of papers B fed to the separator unit 310 is fed one by one by the feeding mechanism 311, is fed to a discrimination unit 320 over the paper path 301 and is discriminated. Thus, it is determined whether the bill is legal or its currency type is specified. A false bill, a bill whose legality cannot be discriminated or a broken bill is discriminated to be abnormal. After the determination, the bill is fed over the paper path 302.

For the upper unit 300, three reject boxes 351-353 are provided. A temporary storage unit 330 is also provided in order to store bills inputted by a customer. A paper path 303 for storing bills in the temporary storage unit 330 and a paper path 304 for storing bills in one of the reject boxes 351-353 are also formed.

The paper path 302 is provided with two switching nails 302*a* and 302*b* for switching the carrying destination of a bill. The subsequent paper path of a bill being carried over the paper path 302 can be switched to the paper paths 303 and 304 by the switching nails 302*a* and 302*b*, respectively. After the determination, a bill is fed from the paper path 302 to the paper path 303 by the switching nail 302*a* and stored in the temporary storage unit 330.

The temporary storage unit 330 is provided with two stages 331 and 332 which can be vertically moved. The stages 331 and 332 are used to accommodate bills that are discriminated to be abnormal and bills that are discriminated to be normal, respectively. For convenience' sake, a storage unit realized by the stage 331 and one realized by the stage 332 are called as a reservoir unit and an escrow unit, respectively. Furthermore, the stages 331 and 332 are called an RSV stage and an ESC stage, respectively.

These stages 331 and 332 are fixed on a belt 335 extended between two pulleys 333 and 334 vertically separated. Each of the two pulleys 333 and 334 and belt 335 can be independently moved by preparing them for each stage. Each of the stages 331 and 332 can also be independently moved by preparing them for each stage.

The paper path 303 is provided with one switching nail so that a piece of bill carrying destination can be selected from the reservoir unit and escrow unit. Thus, a bill fed over the paper path 303 is accommodated in the reservoir. The paper path 304 is provided with two nails so as to accommodate a bill in one of the three rejects boxes 351-353.

The determination and the storage in the temporary storage unit 330 according to its determination result are applied to each of all bills fed one by one by the separator unit 310. Therefore, after being fed from the separator unit 310, the fed bill is accommodated in the reservoir unit or escrow unit. The completion of the carrying is determined by a sensor confirming that there is no bill in the separator unit 310 or by a sensor confirming that no bill is carried to the paper path 301 after attempting to carry a bill.

After the storage to the temporary storage unit 330 of the bill bundle B is completed, the paper handling device 1 notifies the ATM main body of the fact. At that moment, the inputted amount obtained by calculating bills discriminated to normal by the discrimination unit 320 for each currency type is also notified. Thus, the ATM MAIN BODY presents the inputted amount to the customer and inquires the customer whether to conclude a trade, whether to add a bill or the like. After that, the paper handling device 1 operates according to the result of the inquiry.

In the upper part of the temporary storage unit 330, a paper path 305 for carrying a bill bundle B stored in it is provided. The paper path 305 can carry the bill bundle B stored in the temporary storage unit 330 to the acceptor 100. The bill bundle B on the paper path 305 is carried by a carrier 341. The carrier 341 carries the bill bundle B by pushing it from behind the carrying direction. Therefore, the bill bundle B is moved to the backside of each of the stages 331 and 332 (escrow retreat position) and fed.

All the bills accommodated in both the reservoir unit or escrow unit are returned together using the separator unit 310. In that case, bundles of bills are sequentially fed to the separator unit 310.

Since a bill has elasticity, a folded bill attempts to maintain its folded state. Therefore, when bills are simply piled, its height varies depending on the elasticity of each bill. The larger the number of folded bills is, the higher its height becomes. Therefore, the bill bundle B previously fed to the separator unit 310 is supported by a fork 342 which can advance to the front and retreat from it and is avoided from projecting over the paper path 305. The bill bundle B fed on the fork 342 later is piled on the bill bundle already fed to the separator unit 310 by retreating it.

The bill bundle B stored in the temporary storage unit 310 is stored in the lower unit 200 as follows.

An illegal bill, that is, a bill that is not discriminated to be legal is accommodated in a reservoir unit. Therefore, when all bills are accommodated in the reservoir unit, the bills are returned as described above. Thus, only bills accommodated in the escrow unit are carried to the separator unit 310 and are fed one by one. The fed bill is carried to the lower unit 200 via the paper path 301, discrimination unit 320 and paper path 302.

On the lower unit 200, a bill cassette 210 which can be attached/detached for each currency type to be accommodated is mounted. In the upper part of each mounted bill cassette 210, a feeding mechanism 211 for storing bills and feeding accommodated bills is provided. The bill carried to the lower unit 200 is further carried over the paper path 201, is led to the bill cassette 210 to accommodate it by a switching nail provided for the paper path 201 and is accommodated by the feeding mechanism 211. Thus, bills inserted by a customer are accommodated in the bill cassette 210 for each currency type.

Next, the operation at the time of payment is described in detail. The payment is made, for example, by a customer operating the operation panel of the ATM and requesting for the payment of a specified amount of money. When the customer issues the request, the ATM MAIN BODY instructs the paper handling device 1 to discharge bills for the payment amount. If the customer specifies a desired set of currency types, the instructed contents are notified to the paper handling device 1.

Upon receipt of the instruction from the ATM MAIN BODY, for example, the paper handling device 1 determines the number of pieces of bills to be fed for each currency type and the feeding mechanism 211 feeds bills one by one from each bill cassette 210, according to the determination. The fed bills are carried to the discrimination unit 320 via the paper path 202 and the paper path 306 of the upper unit 300 and are discriminated. A bill discriminated to be legal by the discrimination is carried to the escrow unit, and a bill discriminated to be illegal is carried to a reject box 351 or 352.

The carrying of bills to the escrow unit continues until all the bills for the payment amount instructed by the customer are accommodated. After the storage of the bills for the payment amount is completed, the bill bundle B is carried to the acceptor 100 and then is further carried to the input/output slit 101 by the acceptor 100.

In this way, at the time of payment too, bills are carried to the input/output slit of the acceptor 100 in the state of a bill bundle. Therefore, the paper handling device 1 can be installed even in small space which can be secured around the input/output slit 101.

Figure 2:
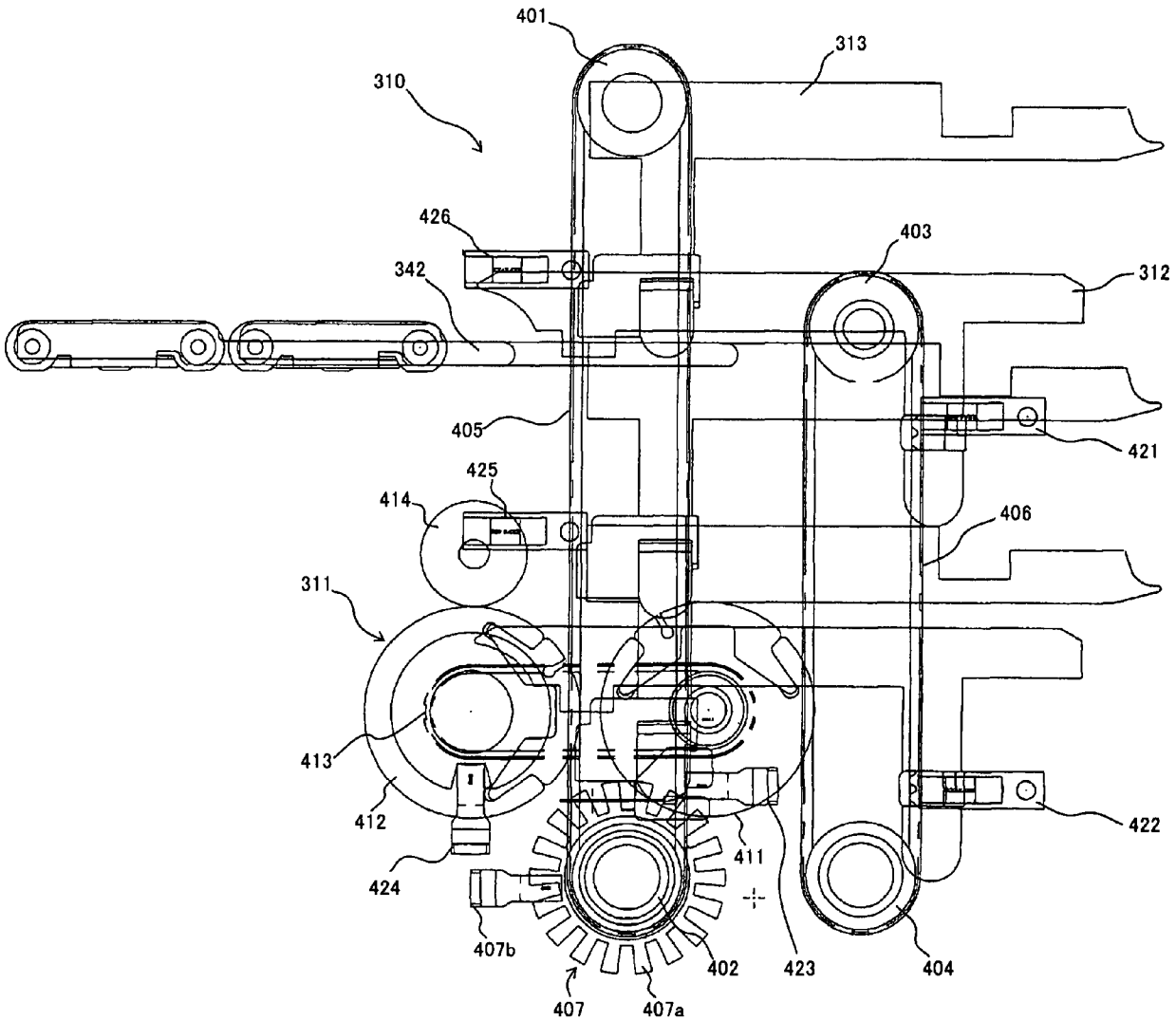
FIG. 2 shows the structure of the separator unit.

As shown in FIG. 2, a feeding mechanism 311 is provided in the lower part of the separator unit 310. The mechanism 311 comprises a pick roller 411 for feeding bills, feed roller 412 for carrying the bills fed by the roller 411 and a separator 414 for preventing the multi-feeding of bills.

Since the pick roller 411 temporarily applies carrying force to a bill, its part touching the bill is composed of a high-friction part and a low-friction part. This also applies to the feed roller 412. For this reason, the rotations of the rollers 411 and 412 are linked by a belt 413. A sensor 424 disposed in the vicinity of the feed roller 412 detects the rotation state of the roller 412. The timing in which bills are fed can be specified by the output signal of the sensor 424.

As well known, in order to feed a bill, the bill and the pick roller must be touched by appropriate pressure. Whether they are touched with such pressure is determined by the position of the pick roller 411 which is moved according to the degree of the pressure. The sensor 423 is disposed to determine it. Since the pick roller is movable, it can be moved upward by applying the elasticity of a spring, which is not shown in FIG. 2, to it upward.

The bill bundle B carried to the separator unit 310 is placed on a stage 312. The stage 312 is mounted on a belt 406 extended between pulleys 403 and 404. Thus, by vertically moving the stage 312, the bill bundle B is moved to the feeding mechanism 311.

A pusher 313 disposed in the upper part of the stage 312 touches the bill and the pack roller 411 with appropriate pressure. For that purpose, the pusher 313 is mounted on a belt 405 extended between pulleys 401 and 402.

On a shaft supporting the pulley 402, a disk 407*a* constituting an encoder 407 is mounted. The encoder 407 comprises the disk 407*a* and a sensor 407*b* for slit detection provided its circumference.

The encoder 407 is provided to check whether the pusher 313 operates normally. In order to move the stage 312, a power source (motor) different from one for the pusher 313 is used. Thus, an encoder for checking whether the stage 312 operates normally, which is not especially shown in FIG. 2, is also provided. Here the same reference numeral is attached to it.

Sensors 421 and 422 provided for the separator unit 310 are used to detect the position of the stage 312. Similarly, sensors 425 and 426 are used to detect the position of the pusher 313. More particularly, the sensors 421, 422, 426 and 425 are used to detect the stage 312 moved to the upper end position of the stage 312, to detect the stage 312 moved to the lower end position, to detect the pusher 313 moved to the upper end position and to detect the pusher 313 moved to the joint preparation position, respectively. The sensors 407*b* and 421-426 are all optical sensors each with a light emitting device and a light receiving device.

The upper end position of the stage 312 means the position onto which the bill bundle B can be moved and the bill bundle B on which can be moved. A carrier 341 moves the stage 312 between the escrow retreat position and the acceptor 100 when both the stage 312 and the pusher 313 are located at the upper end position. The lower end position of the stage 312 means the position to which the stage 312 is moved when feeding bills. The joint preparation position of the pusher 313 means the position to which the pusher 313 is moved when projecting the fork 342 and is located at almost the same height as the upper end position of the stage 312. The pusher 313 touches a bill located at the bottom of the bill bundle B and the pick roller 411 with appropriate pressure. Therefore, the lower end position means the position to which the sensor 423 is lowered so as to detect the pick roller 411 when there is no bill on the stage 312.

In this preferred embodiment, the separator unit such a structure detects the height of a bill bundle B inserted by a customer and calculates the maximum number of pieces of bills to be anticipated to be able to insert at the time of additional deposit, based on the detected height. Its detailed method will be described later.

Figure 3:
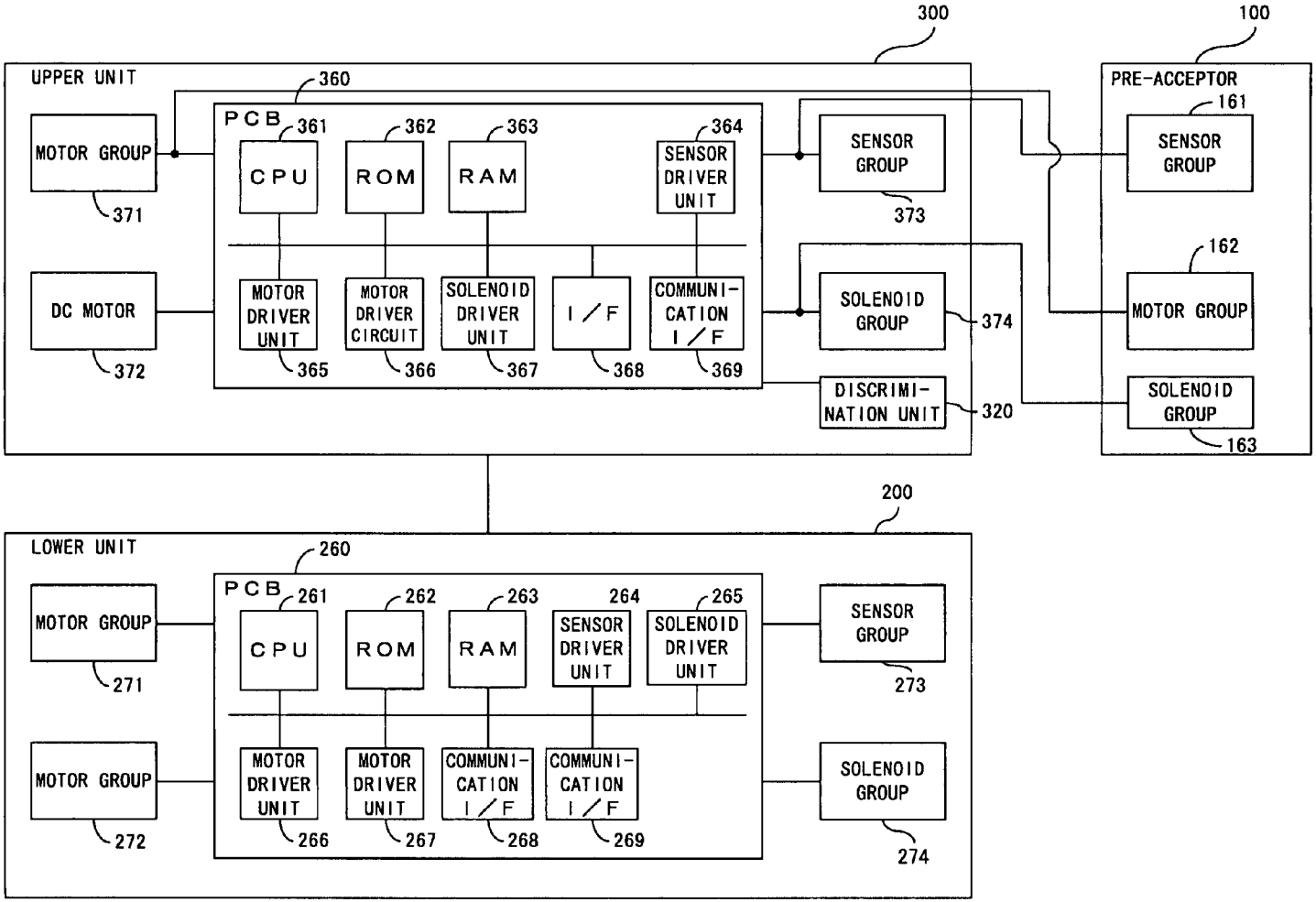
FIG. 3 shows the circuit configuration of the paper handling device of the preferred embodiment.

FIG. 3 shows the circuit configuration of the paper handling device 1.

The above-described acceptor 100 comprises a sensor group 161, a motor group 162 and a solenoid group 163. The sensor group 161 includes a plurality of sensors for detecting a bill bundle B, a plurality of sensors for detecting the position of a member, a sensor for the encoder and the like. The motor group 162 includes a plurality of motors for moving the bill bundle B, a motor for pressing the bill bundle B and the like. These all are stepping motors. The solenoid group 163 includes solenoids prepared for each member for projecting and retreating it.

The lower unit 200 is operated by the control of a printed circuit board (PCB) 260. To the printed circuit board 260, motor groups 271 and 272, a sensor group 273 and a solenoid group 274 are connected.

The motor group 271 includes a plurality of stepping motors. Each stepping motor is a power source for moving a stage provided in a corresponding bill cassette 210. The motor group 272 includes a plurality of stepping motors. Each stepping motor is a power source for the feeding mechanism 211 provided in a corresponding bill cassette 210.

The sensor group 273 includes a sensor for detecting a bill provided on the paper path 201, a sensor (for example, a switch) for detecting the bill cassette 210, a sensor for detecting the position of a stage in the bill cassette 210 and a sensor for detecting a bill accommodated in the bill cassette 210. The solenoid group 274 includes a solenoid prepared for each switching nail on the paper path 201, for switching its state and a solenoid prepared in each bill cassette 210, for conveying power to the feeding mechanism 211.

On the printed circuit board 260, are mounted a CPU 261 for controlling the entire paper handling device 1, ROM 262 for storing programs which are executed by the CPU 261 and a variety of control data, RAM 263 used by the CPU 261 as work memory, a sensor driver unit 264 for driving sensors constituting the sensor group 273, a solenoid driver unit 265 for individually driving a solenoid constituting the solenoid group 274, a motor driver unit 266 for driving a stepping motor constituting the motor group 271, a motor driver unit 267 for driving a DC motor constituting the motor group 272, a communication interface (I/F) 268 for communicating with the upper unit 300 or the like and a communication interface (I/F) 269 for communicating with a higher-order device, such as the ATM MAIN BODY or the like.

The upper unit 300 is also operated by the control of a printed circuit board (PCB) 360. To the printed circuit board 360, motor groups 371 and 162, a DC motor 372, sensor groups 373 and 161, and solenoid groups 374 and 163 are connected. Thus, the acceptor 100 is controlled by the upper unit 300.

The motor group 371 includes a plurality of stepping motors. Each of the carrier 341, stages 312, 331 and 332 and pusher 313 is moved by a stepping motor. For the power source of the pick roller 411 (feed roller 412), such a type of motor is adopted. The DC motor 372 feeds bills from the separator unit 310 and carries them.

The sensor group 373 includes a plurality of sensor for detecting a bill or the carrier 341 on each of the paper paths 301-305, a plurality of sensors 421-426 and 407*b* provided for the separator unit 310 and a plurality of sensors provided for the temporary storage unit 330. The solenoid group 374 includes solenoids for switching the states of switching nails 302*a* and 302*b* on the paper path 301 and switching nails other paths 303 and 304.

On the printed circuit board 360, are mounted a CPU 261 for controlling the entire upper unit 300, ROM 362 for storing programs which are executed by the CPU 361 and a variety of control data, RAM 363 used by the CPU 361 as work memory, a sensor driver unit 364 for driving sensors constituting the sensor groups 373 and 161, a motor driver unit 365 for driving stepping motors constituting the motor groups 371 and 162, a motor driver circuit 366 for driving the DC motor 372, a solenoid driver unit 367 for individually driving solenoids constituting the solenoid groups 374 and 163, a communication interface (I/F) 368 for transmitting/receiving to/from the discrimination unit 320 and a communication interface (I/F) 369 for communicating with the lower unit 200 and the like.

The operation of the paper handling device 1 with such a configuration is described below.

The CPUs 261 and 361 exercise control by executing programs stored by the ROMs 262 and 362, respectively. The CPU 261 receives an instruction from the ATM main body via the communication I/F 269, controls the lower unit 200 according to the instruction and issues an instruction to the upper unit 300. The instruction is transmitted to the CPU 361 of the upper unit 300 via the communication I/Fs 268 and 369.

The CPU 261 receives a variety of detection results from the driver unit 264 from time to time by making the sensor driver unit 264 drive the sensor group 273 and receives contents obtained by communicating with the upper unit 300 or the ATM main body from the communication I/F 268 or 269 from time to time. The CPU 261 analyzes the detection results and communication contents and issues instructions to the solenoid driver unit 265 and motor driver units 266 and 267 according to their situations. Thus, the lower unit 200 is operated under the control of the CPU 261. Information to notify is transmitted from time to time via the communication I/F 268 or 269.

The CPU 361 of the upper unit 300 controls the upper unit 300 and acceptor 100, according to instructions from the lower unit 200. The CPU 361 receives a variety of detection results from the driver unit 364 from time to time by making the sensor driver unit 364 drive the sensor groups 373 and 161, analyzes them and issues instructions to the solenoid driver unit 367, motor driver unit 365, motor driver circuit 366 and discrimination unit 320, according to their situations. Thus, the upper unit 300 and acceptor 100 are operated under the control of the CPU 361. The instruction to the discrimination unit is issued via the communication I/F 368, and information to the lower unit 200 is transmitted from time to time via the communication I/F 369. When taking in a bill bundle B inserted by a customer, its amount of deposit is transmitted to the lower unit 200 as information. When storing bills, the currency types discriminated to be legal are transmitted to the lower unit 200 as information.

Here, a method for detecting the height of a bill bundle B inserted by a customer, by the separator unit 310 and a method for calculating the maximum number of pieces of bills anticipated to be able to insert, based on its detected height at the time of additional deposit are described in detail with reference to FIGS. 4-6.

A bill piled as a bill bundle B is light and has large elasticity compared with its weight. Therefore, when bills are piled, the entire height of the bill bundle B varies depending on the elasticity of each bill. Thus, the height of the bill bundle B is detected in the state where pressure is applied. Thus, the influence on a detection result of the elasticity of each bill can be eliminated and the actual height of the bill bundle B can be accurately detected. First of all, the reason is described.

When carrying bills as a bill bundle B, the height of the bill bundle B that can be carried has an upper limit. In automation equipment, it is customary to restrict an amount of money to be handled at one time. Even if bills are not carried as a bill bundle B when such a limit is set, there is a limit in the height of the bill bundle B. Therefore, it becomes necessary not to handle a bill bundle B whose height exceeds the upper limit.

Even if a bill bundle B can be actually handled in terms of the number of pieces when detecting the height of the bill bundle B piled its weight, sometimes the height of the bundled B exceeds its upper limit depending on the elasticity of the bill. Even if the height exceeds the upper limit due to the elasticity of a bill, the bill bundle B is returned. Therefore, it also requires a customer of more labor than ordinarily necessary as a result. Thus, the efficiency in use of automation equipment degrades. However, if the height is detected in the state where the bill bundle B is pressed, such an accident can be surely avoided. Therefore, a customer can receive services more comfortably and the efficiency in use of automation equipment can be improved.

In automation equipment, in one time of trade, a bill bundle B can be divided into a plurality of bundles and be inserted over a plurality of times. Even if a bill bundle B are inserted over such a plurality of times, the upper limit of height exists. Specifically, the accumulated value of the heights of respective bundles of bills B must be below the upper limit.

In order to accurately detect the height of a bill bundle B, the accumulated value can be accurately calculated. The maximum number of pieces of a bill bundle that can be additionally deposited can be obtained by dividing a height obtained by subtracting the accumulated value from the upper limit by the thickness of one piece of bill. If the maximum number of pieces is notified to a customer, the insertion of bills that cannot handled at the time of additional deposit can be avoided in advance. Thus, serviceability can be improved. By enabling the lower unit 200 to transmit the maximum number of pieces to the ATM main body as information, the ATM main body can notify a customer of it. Since the thickness of each bill varies depending on its used condition or the like, the calculated maximum number of pieces is an assumption.

Next, the detection method of the height of a bill bundle B and the calculation method of the maximum number of pieces of bills supposed to be able to insert at the time of additional deposit are described in detail.

As described above, when feeding a piece of bill out of a bill bundle B on the stage 312, the stage 312 is moved to the lower end position, the pusher 313 is moved downward until the pick roller 411 and a piece of bill at the bottom are touched with appropriate pressure and the bill bundle B is pressed. In this preferred embodiment, the height of the bill bundle B in its pressed state is detected utilizing it. In the following description, as long as specified otherwise, the height of a bill bundle B means a height in the pressed state.

The pusher 313 for pressing the bill bundle B is lowered from the upper end position. While the pusher 313 is being lowered, it passes the joint preparation position. Since the pusher 313 at the joint preparation position can be detected by the sensor 425, the amount of movement of the pusher 313 is specified based on the joint reference position and the height of the bill bundle B is calculated from the amount of movement.

Figure 4:
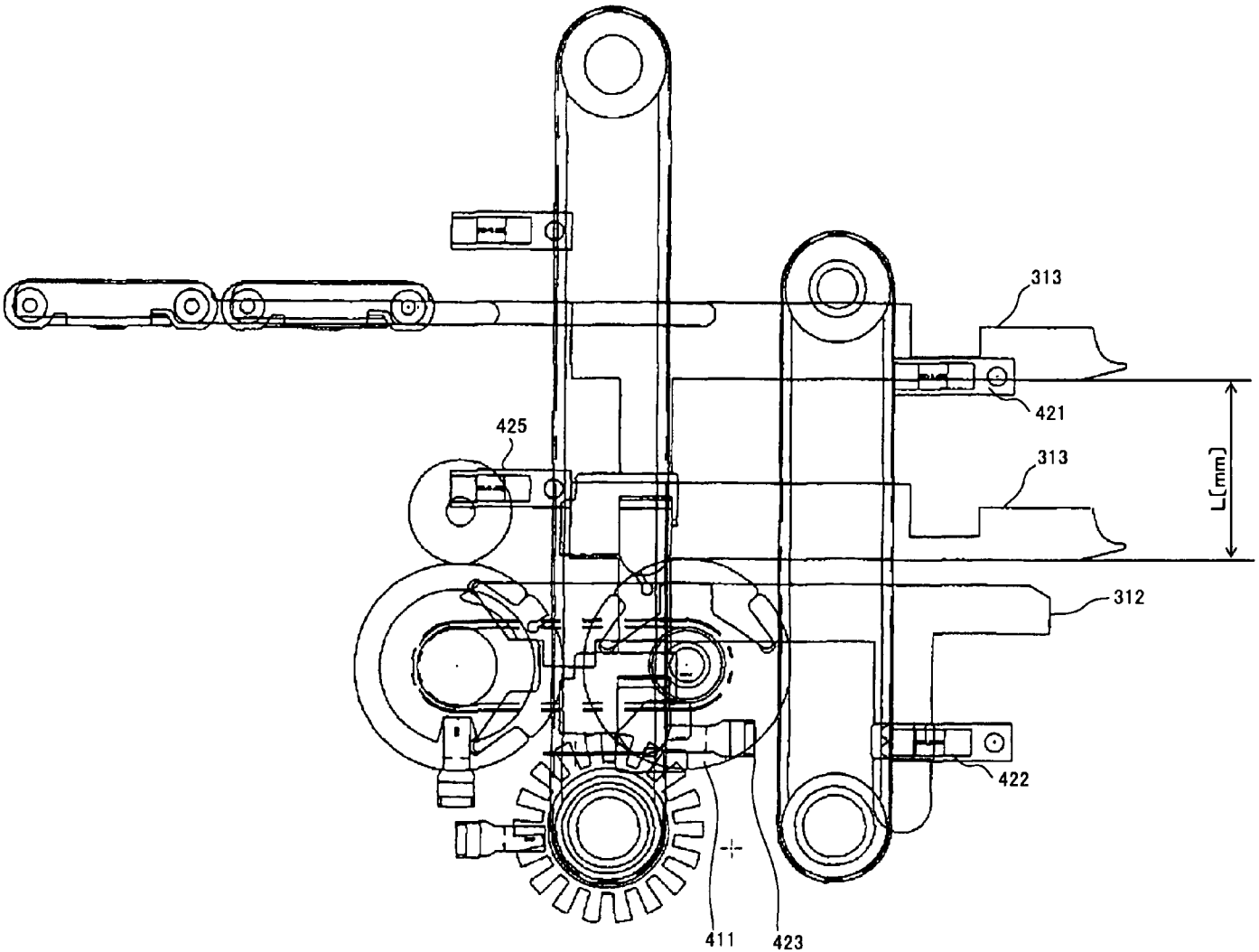
FIG. 4 shows how to detect the height of a bill bundle in the preferred embodiment (No. 1).
Figure 5:
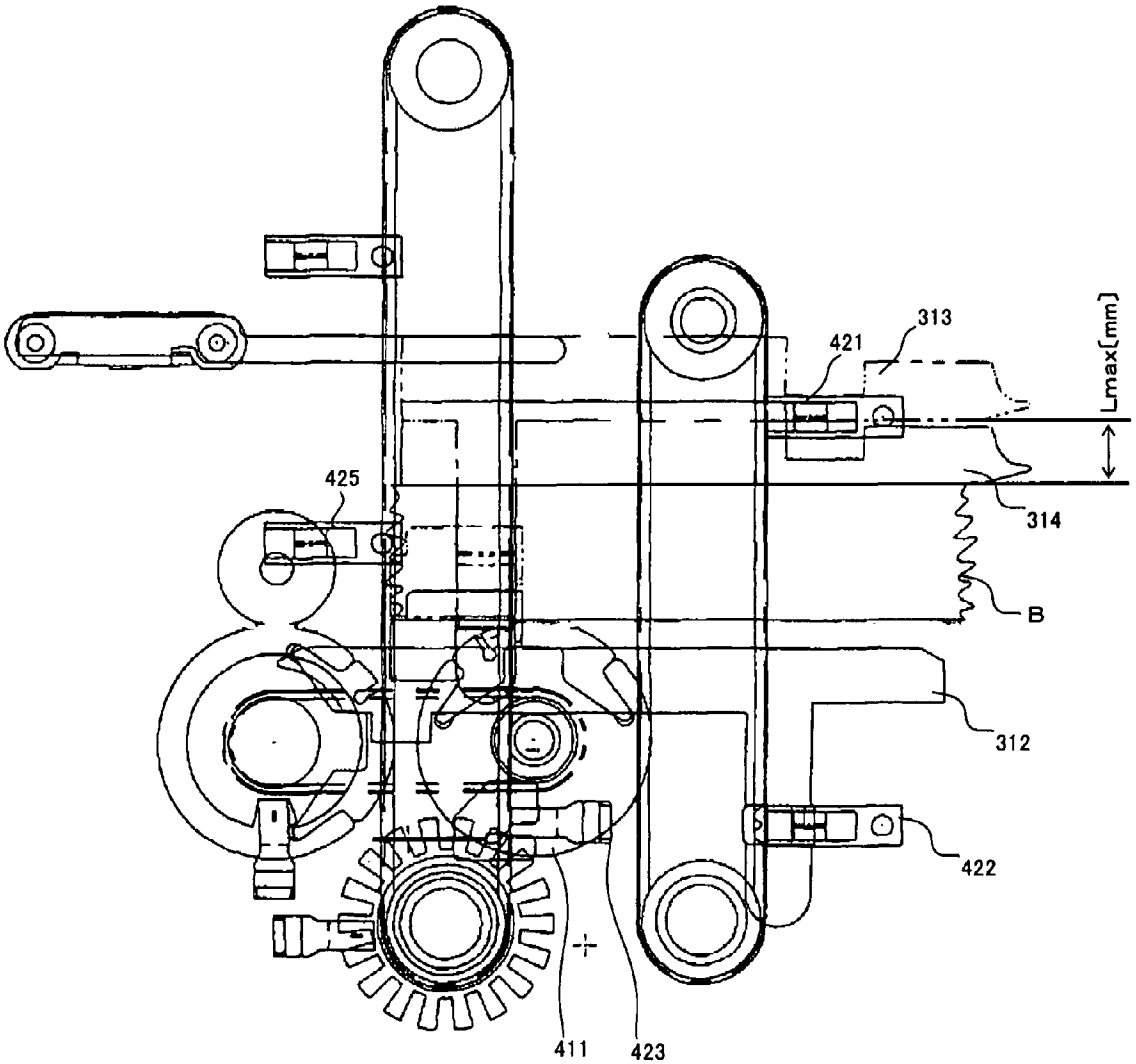
FIG. 5 shows how to detect the height of a bill bundle in the preferred embodiment (No. 2).

The maximum movement distance L from the joint reference position of the pusher 313 is up to a position where the pusher 313 directly presses the pick roller 411, as shown in FIG. 4. If the height of the upper limit of a bill bundle B that can be handled in one time of trade is $H_{max}$, the movement distance $L_{max}$ from the joint reference position of the pusher 313 in the case where a customer inserts a bill bundle B of the upper limit of height $H_{max}$ becomes as shown in FIG. 5. For the movement distance $L_{max}$, one calculated as follows is adopted in order to secure allowance on the safety side. K1 is a co-efficient larger than 1.

$$L_{max}=L-H_{max}\times K1 \quad (1)$$

By maintaining the number of driving pulses applied to a motor (stepping motor) for pusher 313 movement for a unit hour constant, the movement speed of the pusher 313 is maintained constant. Thus, the pusher 313 is lowered in order to press the bill bundle B, the sensor 425 counts a time until the sensor 423 detects the pick roller 411 after the sensor 425 detects the pusher 313, by monitoring the respective detection results of the sensors 425 and 423, received from the sensor driver unit 364. If a counted time and the movement speed of the pusher 313 are Tt and ΔL, respectively, the distance Lt covered by the pusher 313 while the time Tt elapses can be calculated as follows.

$$Lt=Tt\times\Delta L \quad (2)$$

The height Ha of the inserted bill bundle B can be calculated as follows.

$$Ha=L-Lt \quad (3)$$

Figure 6:
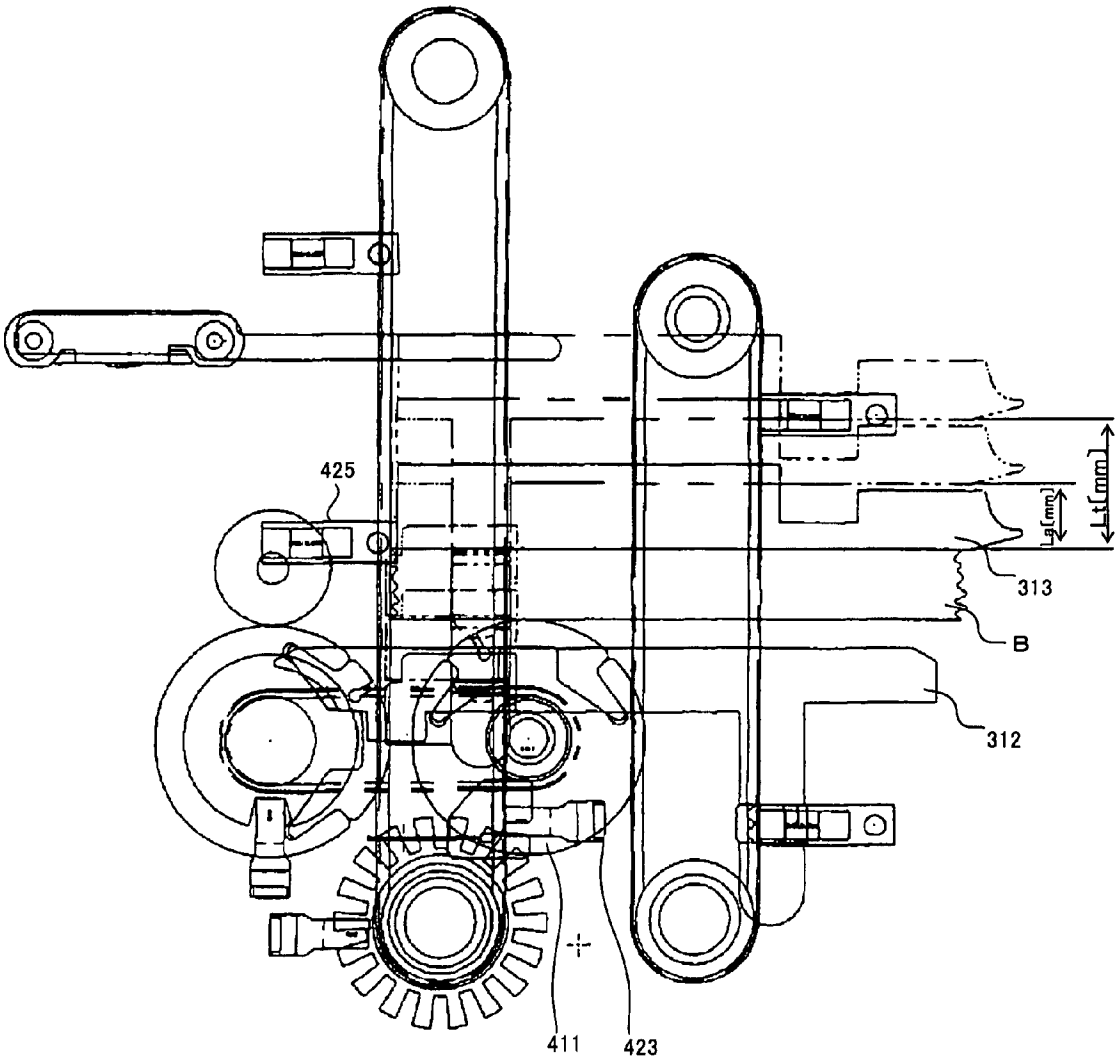
FIG. 6 shows how to detect the height of a bill bundle in the preferred embodiment (No. 3).

As shown in FIG. 6, if the bill bundle B whose height Ha is calculated is inserted at the beginning of the trade, a distance La obtained by subtracting the distance $L_{max}$ from the distance Lt becomes the maximum height of the bill bundle B that can be inserted at the time of subsequent insertion. Therefore, by dividing the distance La by the thickness Hb of a piece of bill, the maximum number of pieces ΔX of bills that can be inserted at the time of subsequent insertion can be calculated.

A piece of bill can be issued with a specific thickness. However, the thickness Hb varies somewhat depending on its used condition. Therefore, in this preferred embodiment, the maximum number of pieces ΔX is calculated using the thickness Hb obtained by dividing the height Ha of the bill bundle B by the number of pieces of bills. By calculating the maximum number of pieces ΔX based on an actually distributed bill thus, the accumulated value of the height Ha of the bill bundle B is more surely prevented from exceeding the upper limit of height $H_{max}$ when a customer inserts the maximum number of pieces ΔX of bills. The number of pieces of bills can be obtained by counting the number of piece of bills fed from the separator unit 310.

The accumulated value of the height Ha of the bill bundle B inserted so far is calculated every time a bill bundle B is inserted. When the accumulated value exceeds the upper limit of height $H_{max}$, the bill bundle B inserted last, that is, the bill bundle existing in the separator unit 310 is returned to a customer. Otherwise, the maximum number of pieces ΔX of bills that can be inserted at the time of subsequent insertion is calculated by dividing a value obtained by subtracting the accumulated value from the upper limit of height $H_{max}$ by the thickness Hb of a piece of bill. Thus, information useful to appropriately insert bills can be presented to a customer from time to time and more comfortable services can be provided.

The CPU 361 performs the above-described detection of the height Ha, the calculation of the maximum number of pieces ΔX and the like. The maximum number of pieces ΔX calculated by the CPU 361 is notified from the CPU 361 to the ATM main body via the CPU 261 of the lower unit 200.

Figure 7:
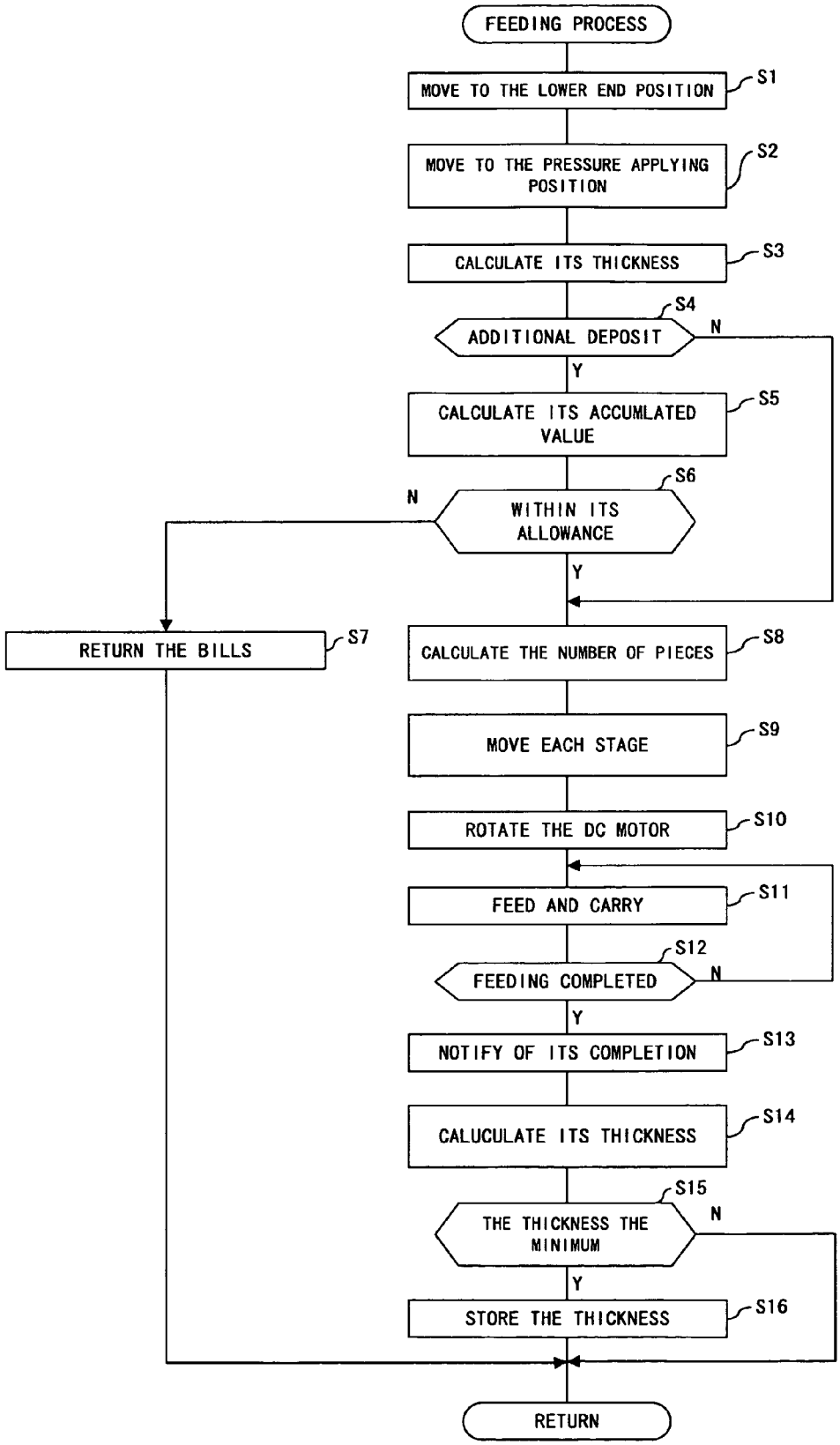
FIG. 7 is a flowchart showing the feeding process.

FIG. 7 is a flowchart showing the feeding process. The feeding process is performed after the bill bundle B inserted by a customer is carried onto the stage 312 of the separator unit 310. By performing the process, bills are fed out of the bill bundle B on the stage 312 one by one and are stored in the temporary storage unit 330. The detection of the height Ha, the calculation of the maximum number of pieces ΔX and the like are also performed together. Therefore, only the feeding process is described here.

As described above, the operation of the paper handling device 1 is realized by the CPU 261 of the lower unit 200 controlling the lower unit 200 and the CPU 361 of the upper unit 300 controlling the upper unit 300 and the acceptor 100 under the control of the CPU 261. Since the feeding of bills out of the separator unit 310 is controlled by the CPU 361, it is described here focusing on the CPU 361.

Firstly, in step 1, the detection result of the sensor 422 is monitored and the stage 312 is lowered up to the bottom. In step 2, the pusher 313 is lowered from the upper end position up to a position where appropriate pressure is allied to a bill bundle B (pressure applying position). At time moment, time Tt until the sensor 423 detects the pick roller 411 after the sensor 425 detects the pusher 313 is counted by monitoring the respective detection results of sensors 425 and 423 that are received from the sensor driver unit 364. The time is counted, for example, using a timer installed in the CPU 361. The detection result of the sensor 407*b* of movement encoder 407 is also monitored in order to check whether the pusher 313 normally moves.

In step 3, the distance Lt is calculated according to equation (2), using the counted time Tt. Furthermore, the height (thickness) Ha of the bill bundle B is calculated according to equation (3), using the calculated distance Lt. In step 4, it is determined whether the bill bundle B whose height Ha is calculated is inserted as additional deposit. If the bill bundle B is newly inserted as additional deposit, the determination is yes and the process proceeds to step 5. If not, the determination is no and the process proceeds to step 8.

The height Ha of the inserted bill bundle B is calculated for each bill bundle B by performing the process in step 3. In step 5, its accumulated value is calculated by summing all the heights Ha of respective bundles of bills B inserted from the beginning of a trade. Then, in step 6, it is determined whether the accumulated value exceeds a permitted range, that is, the upper limit of height $H_{max}$. If the accumulated value is larger than the upper limit of height $H_{max}$, the determination yes and the process proceeds to step 8. If not, the determination is no and the process proceeds to step 7. In step 7, a newly inserted bill bundle B is carried up to the input/output slit 101 and is returned to a customer and a series of the process are terminated.

In this preferred embodiment, while after the bill bundle B is inserted in the input/output slit 101, it is carried by the acceptor 100, it is checked whether it can be handled. The determination in step 4 is performed for that purpose.

In step 8, according to whether the inserted bill bundle B is additional deposit, either the height Ha calculated in step 3 or the accumulated value calculated in step 5 is selected, and the maximum number of pieces ΔX that can be inserted as subsequent additional deposit is calculated by dividing the selected height by the thickness Hb of a piece of bill.

In step 9, the carrier 341 is moved to the escrow retreat position and the respective stages 331 and 332 of the temporary storage unit 330 are moved in order to accommodate bills. In step 10, the DC motor 372 is rotated. After the motor 372 is started to rotate, bills are sequentially fed out of the separator unit 310 one by one and are carried to the temporary unit 330 until the feeding of bills out of the separator unit 310 is completed (S11 and S12). Thus, bills inserted by a customer are accommodated in the reservoir unit or the escrow unit.

Bills are fed by conveying power to the pick roller 411 and feed roller 412 of the feeding mechanism 311, and the accommodation destination of the bills is determined by discriminating a fed bill by the discrimination unit 320. The number of pieces of bills discriminated to be legal counted for each currency type. In order to apply appropriate pressure while feeding bills, the pusher 313 is intermittently lowered.

After the feeding of bills carried to the separator unit 310 is completed, that is, all the bills that can be fed are fed out and stored in the temporary storage unit 330, the determination in step 12 becomes yes and the process proceeds to step 13. In step 13, the DC motor 372 is stopped and the completion of the feeding is notified to the CPU 261 of the lower unit 200. At this moment, the amount of deposit, the maximum number of pieces ΔX and the like are also notified.

The CPU 261 transmits these pieces of information notified by the CPU 361 of the upper unit 300 to the ATM main body. Thus, the ATM main body presents the amount of deposit, the maximum number of pieces ΔX and the like to the customer and inquires about the request of the customer.

In step 14, the thickness Hb of a piece of bill is calculated from the height Ha calculated in step 3 and the number of pieces of fed bills. In step 15, it is determined whether the calculated thickness Hb is smaller than one used to calculate the maximum number of pieces ΔX in step 8. If the calculated thickness Hb is smaller, the determination is yes and the process proceeds to step 16. If not, the determination is no and a series of processes are terminated here.

In this way, in this preferred embodiment, after the thickness Hb is calculated, the minimum thickness Hb so far is stored by checking whether the thickness Hb is smaller than ever. Thus, the maximum number of pieces ΔX is calculated based on the best conditioned one among the actually inserted bundled of bills.

However, there is an error in movement distance Lt calculated by counting time Tt. In order to avoid such an error, in this preferred embodiment, the lowest height Ha of a bill bundle B whose thickness Hb is calculated is preset. Since the discrimination unit 320 sometimes discriminates a legal bill carried in multiple to be illegal by mistake, a bill bundle B among which an illegal bill is detected is removed from calculation targets. Thus, more appropriate thickness Hb is stored. When thickness Hb is updated thus, it is necessary to store a value a little bit larger than the calculated one as its initial value.

Although in this preferred embodiment, a bill bundle B is vertically piled and inserted, there is always no need to insert it in such a way. Specifically, the bill bundle B can also be inserted in such a way that the longitudinal direction or shorter direction of a piece of bill can be set vertical or almost vertical.

What is claimed is:

1. A method which is applied to a paper handling device for detecting a height of a paper bundle, comprising:

applying pressure on the paper bundle externally inserted which is piled at least one paper, in a piled direction of the paper bundle;

detecting a height of the paper bundle in a state where the pressure is applied; and calculating a maximum number of pieces of paper anticipated to be subsequently inserted based on a height detected for each paper bundle already inserted and a predetermined upper limit of height of each of the paper bundles, when the paper bundle to be handled together can be inserted in the paper handling device over a plurality of times;

wherein the maximum number is calculated by using a thickness of one piece of paper, the thickness being calculated based on the number of pieces of the paper fed out from the paper bundle and the height detected for each paper bundle.

2. A paper handling device capable of handling externally inserted papers, comprising:

a feeding unit for feeding out the papers one piece by one piece from a paper bundle which is piled at least one paper and was inserted from the externally;

a height detection unit for detecting a height of the paper bundle pressed by the feeding unit; and a carrying control unit for determining whether the height of the paper bundle detected by the height detection unit exceeds a predetermined height upper limit and externally discharging the paper bundle of the feeding unit when it is determined that the detected height exceeds the upper limit, and for calculating a maximum number of pieces of papers anticipated to subsequently insert based on a height detected for each paper bundle and a predetermined upper limit of height of each of the paper bundles, when the paper bundle to be bundled together can be inserted over a plurality of times and for notifying an external device of the maximum number;

wherein the carrying control unit calculates thickness of one piece of paper in the paper bundle, based on the number of pieces of the paper bundle, fed out by the feeding unit and the height detected by the height detection unit and calculates the maximum number of pieces, using the calculated thickness.

* * * * *